US005688289A

United States Patent [19]

Nishioka et al.

[11] Patent Number: 5,688,289

[45] Date of Patent: Nov. 18, 1997

[54] METHOD OF LAUNDERING CLOTHES AND TEXTILES

[75] Inventors: Yukiko Nishioka; Ryoichi Shinjo; Yoshihiro Ishii, all of Kanagawa-ken; Tadao Yamanaka, Chiba-ken, all of Japan

[73] Assignee: Ebara Corporation, Tokyo, Japan

[21] Appl. No.: 637,342

[22] Filed: Apr. 25, 1996

[30] Foreign Application Priority Data

Apr. 28, 1995 [JP] Japan ..... 7-129614

[51] Int. Cl.[6] ..... D06F 17/12; D06L 3/04

[52] U.S. Cl. ..... 8/137; 8/107; 8/111; 8/149.1

[58] Field of Search ..... 8/137, 111, 110, 8/107, 102, 149.1, 149.2; 510/302, 303

[56] References Cited

U.S. PATENT DOCUMENTS

| | | | |
|---|---|---|---|
| 4,692,275 | 9/1987 | Secemski et al. | 510/472 |
| 5,404,732 | 4/1995 | Kim | 68/13 R |
| 5,484,549 | 1/1996 | Hei et al. | 510/370 |

FOREIGN PATENT DOCUMENTS

| | | |
|---|---|---|
| 5-253380 | 10/1983 | Japan . |
| 63-73990 | 4/1988 | Japan . |
| 2-149293 | 6/1990 | Japan . |
| 3-146094 | 6/1991 | Japan . |
| 4-244198 | 9/1992 | Japan . |
| 5-161773 | 6/1993 | Japan . |
| 5-253380 | 10/1993 | Japan . |
| 5-261200 | 10/1993 | Japan . |
| 5-337300 | 12/1993 | Japan . |
| 6-182086 | 7/1994 | Japan . |
| 6-48592 | 7/1994 | Japan . |
| 6-313194 | 11/1994 | Japan . |
| 6-319891 | 11/1994 | Japan . |
| 7-88277 | 4/1995 | Japan . |

OTHER PUBLICATIONS

"14. Washer for Business Use" in the book of *Encyclopedia of Detergent and Washing*, edited by Haruhiko Okuyama and Motoyoshi Minagawa, published by Asakura Publishing House, 1990 (Month Unknown).

"Ozone Disinfection and Wastewater Treatment Importance of Interface Action", Science and Engineering, by Richard and M. Conan, vol. 2, pp. 139–158 (Date Unknown).

Detergent Cleaning Dictionary, pp. 56–73, published by Asakura Shoten, Nov. 15, 1991, second edition and a partial English translation thereof.

*Primary Examiner*—Alan Diamond

*Attorney, Agent, or Firm*—Armstrong, Westerman, Hattori, McLeland & Naughton

[57] ABSTRACT

An improved method of laundering clothes and textiles comprises: providing a washing machine having a tub furnished with a fixed outer shell 11 and an inner cylinder 12 that is provided within the outer shell 11, that is rotatably supported on a horizontal rotating shaft 13 and that has a plurality of orifices in the outer peripheral wall through which a washing solution can pass; putting the clothes and textiles into the inner cylinder 12; charging the outer shell 11 with a washing solution Q having a polyelectrolyte containing detergent dissolved therein; and laundering the clothes and textiles with ozone gas from an ozonizer 21 being introduced from an ozone gas supply port 24*a* directly into the washing solution Q at a temperature of from about 40° C. to less than 50° C., preferably from about 40° C. to about 45° C. between the outer shell 11 and inner cylinder 12. The method has such a great laundering power that severe soiling of the collar and yellowing can be removed in a regular washing cycle without employing any preliminary or post treatments. In addition, the method can be implemented with existing commercial washing machines with ozone being readily introduced into washing solutions even if no special means is employed to mix them with ozone gas.

15 Claims, 3 Drawing Sheets

METHOD OF LAUNDERING CLOTHES AND TEXTILES

BACKGROUND OF THE INVENTION

This invention relates to a method of laundering various kinds of clothes and textiles with washing solutions as ozone gas is introduced thereinto.

While various techniques of the type contemplated by the invention are known in the art, Japanese Patent Public Disclosure No. 73990/1988 teaches a method in which clothes and textiles are laundered with suds as ozone is blown into a washing machine through a diffuser pipe. Japanese Patent Public Disclosure No. 244198/1992 teaches a similar method, in which the washing solution to be supplied into a washing machine is supplied with ozone gas from an ozonizer through a gas-liquid mixer.

According to the studies conducted by the present inventors, it has been found that the effectiveness of washing solutions mixed with ozone gas is also affected greatly by the type of detergent used. However, both of the prior art methods mentioned above are based on mixing washing solutions with ozone gas and, in the absence of any teaching on which kinds of detergents should be dissolved in liquid media to be mixed with ozone gas, it has been difficult to clean severely stained collars and yellowing by a regular washing cycle without applying any preliminary treatments.

Another problem with these prior art methods is that it has been impossible or extremely difficult to adapt them to existing washing machines since special means such as diffuser pipes or gas-liquid mixers are necessary to have ozone gas mixed with washing solutions. In addition, the ozone gas to be used is the product of ozonization of air by discharge and the NOx it contains will acidify the washing solutions. Laundering is best achieved with aqueous washing solutions that are maintained under alkaline conditions at a pH of about 11, but NOx will react with water to form nitric acid, which acidifies the washing solutions, thereby reducing their laundering power.

SUMMARY OF THE INVENTION

The present invention has been achieved under these conditions and has as a first object providing a method of laundering clothes and textiles that has greater laundering power than the conventional methods which use washing solutions mixed with ozone gas and which is capable of removing severe soiling around the collars and yellowing by the regular washing cycle without employing any preliminary or subsequent treatment.

A second object of the invention is to provide a method that is capable of laundering clothes and textiles by means of existing commercial washing machines with ozone being readily introduced into washing solutions even if no special means is employed to mix them with ozone gas.

The first object of the invention can be attained by the method recited in claim 1, which launders clothes and textiles with a washing solution having a polyelectrolyte containing detergent dissolved therein as ozone gas is directly mixed into the washing solution at a temperature of from about 40° C. to less than 50° C., preferably from about 40° C. to about 45° C.

The second object of the invention can be attained by the method recited in claim 2, which comprises: providing a washing machine having a tub furnished with a fixed outer shell and an inner cylinder that is provided within said outer shell, that is rotatably supported on a horizontal rotating shaft and that has a plurality of orifices in the outer peripheral wall through which a washing solution can pass; placing clothes and textiles into the inner cylinder; charging the outer shell with a washing solution having a polyelectrolyte containing detergent dissolved therein; and laundering the clothes and textiles with ozone gas being introduced directly into said washing solution between the outer shell and inner cylinder of the tub.

The second object of the invention can also be attained by the method recited in claim 3, which is a modification of claim 2 in that the ozone gas is supplied into the tub from the bottom of the outer shell.

The second object of the invention can also be attained by the method recited in claim 4, which is a modification of claim 2 in that the ozone gas is mixed into the washing solution only in the washing step of the laundering process.

The second object of the invention can also be attained by the method recited in claims 5 to 8, which is a modification of claim 1, 2, 3 or 4, in that the ozone gas has been generated by electrical discharge from oxygen gas at a concentration of 70% or more.

The second object of the invention can also be attained by the method recited in claims 9 to 14, which is a modification of claim 1, 2, 3, 4 or 5, in which the clothes and textiles to be laundered are of a uniform color and chiefly made of cotton and/or polyesters.

DETAILED DESCRIPTION OF THE INVENTION

Figure 1:
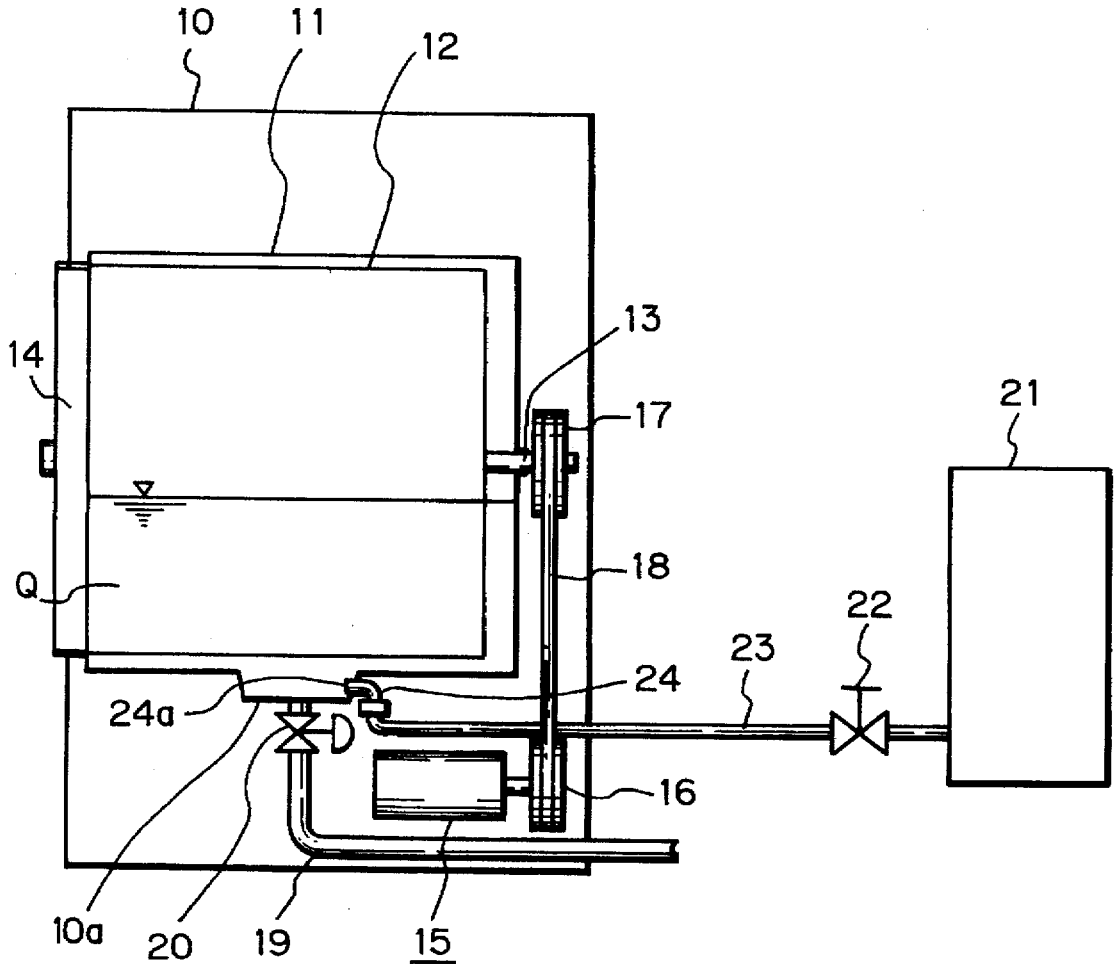
FIG. 1 shows schematically a commercial laundering apparatus for implementing the laundering method of the invention.

The detergents to be used in the invention are those commonly used at commercial laundries and comprise anionic and nonionic surfactants in a powder form, as well as suitable combinations thereof. Exemplary anionic surfactants include straight-chained alkylbenzenesulfonates, α-olefinsulfonates, alkyl sulfates, polyoxylene alkyl sulfates, polyoxyethylene alkylphenyl sulfates, etc. Exemplary nonionic surfactants include alkylpolyoxyethyleneethers, alkylphenylpolyoxyethyleneethers, polyoxyethylene polyoxypropylene glycol, aliphatic acid diethanolamides, N,N-di(polyoxyethylene) alkaneamides, etc.

Examples of the polyelectrolyte that can be used in the invention include carboxymethyl cellulose, polyacrylic acid or salts thereof, alginic acid or salts thereof, and polyacrylamide. These polyelectrolytes are used in amounts that generally range from 0.5 to 2 wt %, preferably from 1 to 2 wt %, of the detergent used.

In the invention, ozone gas is supplied in amounts ranging from about 4 to about 40 mg/h per liter of the washing solution that has the detergent (containing the polyelectrolyte) dissolved in a quantity that is generally held to be appropriate and necessary for the laundering purpose. However, depending on the degree of soiling and staining of the articles to be laundered, the activity of the washing solution and other factors, more than 40 mg/h of ozone gas may be required.

According to the method recited in claim 1, ozone gas is directly introduced into a washing solution containing a polyelectrolyte and due to the interaction between the ozone gas and the polyelectrolyte, the concentration of residual ozone in the washing solution at a temperature of from about 40° C. to less than 50° C., preferably from 40° C. to about 45° C., is sufficiently increased to enhance the utilization of ozone.

The direct mixing of ozone gas into the washing solution which has a detergent dissolved in the presence of a polyelectrolyte is effective in enhancing the detersive power of the washing solution compared to the case where it does not contain the polyelectrolyte. This would be because the polyelectrolyte acts on the mass transfer of ozone at the interfaces between water, the article to be laundered and the soil on it or at the interface between water and the soil, whereupon the ozone is effectively moved through the washing solution to assist in the removal of the soil and the cleaning of the washing solution.

According to the method recited in claim 2, ozone gas is directly mixed into the washing solution between the outer shell and inner cylinder of the tub. The method achieves not only the advantages of the method recited in claim 1 but it also offers the advantage that even if no special ozone mixing means is added to existing commercial washing machines, the inner cylinder of the tub need only be rotated to ensure that the ozone gas is effectively dispersed and dissolved in the washing solution such that the article to be laundered is uniformly contacted by the ozone.

In the method recited in claim 3, ozone gas is supplied into the washing tub from the bottom of the outer shell and hence it can be dispersed and dissolved more effectively in the washing solution.

In the method recited in claim 4, ozone gas is mixed into the washing solution only in the washing step of the laundering process and this is effective in reducing the consumption of the ozone gas.

In the method recited in claims 5 to 8, the ozone gas to be used is generated by electrical discharge from oxygen gas at a concentration of at least 70% and, hence, compared to the case of ozonizing air, the amount of NOx in the ozone gas is insufficient to react with water to form nitric acid and this effectively prevents acidification of the washing solution.

In the method recited in claims 9 to 14, clothes and textiles of a uniform color that are chiefly composed of cotton and/or polyesters are the articles to be laundered and this eliminates the possibility of accidental decolorizing due to the strong bleaching action of ozone.

EXAMPLE 1

An example of the invention will now be described with reference to FIGS. 1–3. FIG. 1 shows schematically a commercial laundering apparatus for implementing the laundering method of the invention. Shown by 10 is a washing machine which comprises a fixed outer shell 11 as part of the washing tub and an inner cylinder 12 that is provided within the outer shell 11 and which is rotatably supported on a horizontal rotating shaft 13. Although not shown, a plurality of orifices through which a washing solution can pass are made in the outer peripheral wall of the inner cylinder 12. A pulley 17 is provided at an end of the horizontal rotating shaft 13 and a belt 18 is stretched between the pulley 17 and another pulley 16 that is connected to the main shaft of a motor 15 such that the inner cylinder 12 can be driven with the motor 15.

The outer shell 11 has a liquid reservoir **10*a* in the bottom which is furnished with a fitting 24 and an ozone gas supply port 24*a* of the fitting 24 is open to the interior of the liquid reservoir 10*a*. Shown by 21 is an ozonizer and the ozone gas it generates is passed through a stop valve 22, an ozone gas supply pipe 23 and the fitting 24 to be released into the liquid reservoir 10*a* via the ozone gas supply port 24*a*. A drain pipe 19 is connected to the bottom of the liquid reservoir 10*a* via a valve 20. In order to ensure that the articles to be laundered will have direct contact with the ozone gas in the washing solution Q, the ozone gas supply port 24*a* is not equipped with any special device or tool for ozone gas dispersing or ozone gas injection. Shown by 14** is a door fitted on the washing tub.

The laundering apparatus having the construction just described above will be operated as follows. First, clothes and textiles as articles to be laundered are put into the inner cylinder 12 of the washing tub. The washing machine 10 is available in two types according to the throughput of one laundering operation, i.e., 30 kg and 20 kg. When a button on a control unit (not shown) is touched to start laundering in auto mode, water having a temperature of about 45° C. is supplied into the inner cylinder 12 (which should be compared with the temperature of the conventionally supplied water ranging from 50° C. to 60° C.). When the water being supplied reaches a specified level, a detergent is charged into the outer shell 11. Typically, "ODOROKI" of 2-M Chemicals Co., Ltd. may be used as the detergent; this is a synthetic detergent for commercial laundering that contains about 1% of carboxymethyl cellulose but which does not contain any enzymes. If the articles to be laundered weigh 30 kg, the detergent is charged in an amount of 750 g; if the articles weight 20 kg, the detergent is charged in an amount of 500 g.

In the next step, stop valve 22 is opened to start charging of ozone gas, which will continue for 15–20 min until the washing step ends. The ozone gas is to be supplied at a flow rate of 1–2 NL/min (under the standard conditions at 0° C. and 1 atm.) and in a quantity of 0.3–2.0 g/h. When the washing step ends, stop valve 22 is closed to stop the supply of ozone gas. In order to ensure against failure to close stop valve 22, a timer fitted with an alarm is actuated simultaneously with the start of ozone charging such that the alarm will signal the end of ozone charging.

If desired, stop valve 22 may be of a power-drive type such that it can be opened and closed by means of an electric control unit fitted with a timer. After the end of the washing step, light dehydration and submerged rinsing may be performed two or three times and a final dehydration step follows to complete the laundering process. Starches and fabric softeners are charged in a final rinse cycle. As in the prior art, the amount of starches and fabric softeners to be charged is variable between 100 cc and 200 cc depending upon the manner in which the laundered articles are to be finished.

If the articles to be laundered are mainly composed of men's shirts, the number of shirts that can be handled by single laundering is 170 (compared to 120 in the conventional case) in the 30-kg type machine and 120 (compared to 80 in the conventional case) in the 20 kg-type. The articles which should ideally be dry-cleaned can be laundered effectively without any problems by applying the embodiment shown in FIG. 1. The same embodiment can also be applied to those articles which have been sorted at dry-cleaning plants articles that must be laundered. Since these articles often comprise delicate and expensive materials, care should be taken to assure that they will not be contacted by ozone gas in any areas other than within the washing solution.

The laundered articles (including both men's shirts and articles water washed instead of being dry-cleaning) are characterized by the following features:

(a) they have not been decolorized;

(b) those having colored patterns come out well;

(c) enhanced whiteness is provided;

(d) no body soils will remain at collars;

(e) only slight wrinkling occurs; and (f) no shrinkage occurs.

Features (e) and (f) are due to the fact that the temperature of the water being supplied is sufficiently low (about 45° C.) to reduce the thermal stress that may be exerted on the articles to be laundered.

As described above, mixing ozone gas into the washing solution that has a suitable amount of detergent dissolved therein in the presence of a polyelectrolyte is effective in that the supplied ozone gas interacts with the polyelectrolyte to enhance the permeation of the washing solution into the articles to be laundered and this combines with the effective transfer of ozone to the articles to be laundered, thereby achieving an enhanced detersive effect.

EXAMPLE 2

This example is provided to demonstrate that laundering can be accomplished at lower temperatures than in the prior art by mixing ozone gas directly into washing solutions having a polyelectrolyte containing detergent dissolved therein.

Laundering is conventionally performed with washing solutions at comparatively high temperatures (50°–60° C.) and most of the detergents used in laundering are adapted for correspondingly high temperatures of 50°–60° C. Hence, these detergents are ineffective in cold washing solutions. To avoid damage to the articles to be laundered, lower temperatures are desired but lowering the temperature of washing solutions has been impossible without reducing the effectiveness of common detergents for laundering which are to be added to said washing solutions. However, even such detergents for use at high temperatures can prove effective at lower temperatures of about 40°–about 45° C. if they are dissolved in washing solutions in the presence of ozone and the detergency is higher than in the case of laundering at the conventional high temperatures (50°–60° C.) in the absence of ozone.

To show this fact, a laundering experiment was conducted under three different conditions, A, B and C (see below).

Condition A: Laundering was performed with the same washing solution as in Example 1 at about 40° C. in the absence of ozone.

Condition B: Laundering was performed with the same washing solution as in Example 1 but at the conventional about 60° C. in the absence of ozone.

Condition C: Laundering was performed with the same washing solution as in Example 1 at about 40° C. in the presence of ozone.

The same detergent was used in the same quantity under all conditions. For each of these conditions, the procedure of Example 1 was repeated except on the presence or absence of ozone and on the temperature of the washing solution.

The articles laundered under conditions A, B and C were evaluated by a panel of six skilled workers at laundries. For the sharpness of colored patterns, whiteness, removal of soiling from collars, the number of wrinkles and the extent of shrinkage. The results are shown in Table 1.

TABLE 1

| Condition | A | B | C |
|---|---|---|---|
| Sharpness of colored patterns | X | ○ | ◎ |
| Whiteness | X | ○ | ◎ |
| Removal of body soils from collars | X | ○ | ◎ |
| Smallness in the number of wrinkles | ○ | Δ | ◎ |
| Smallness in the extent of shrinkage | ○ | ○ | ◎ |

Criteria for rating:
◎, excellent; ○, good; Δ, fair; X poor.

In the ozonizer 21, oxygen gas having a concentration of at least 70% is subjected to electrical discharge to generate ozone gas. As a result, the amount of NOx in the ozone gas is so small that it will react with water only insufficiently to form nitric acid which would otherwise render the washing solution acidic.

Figure 2:
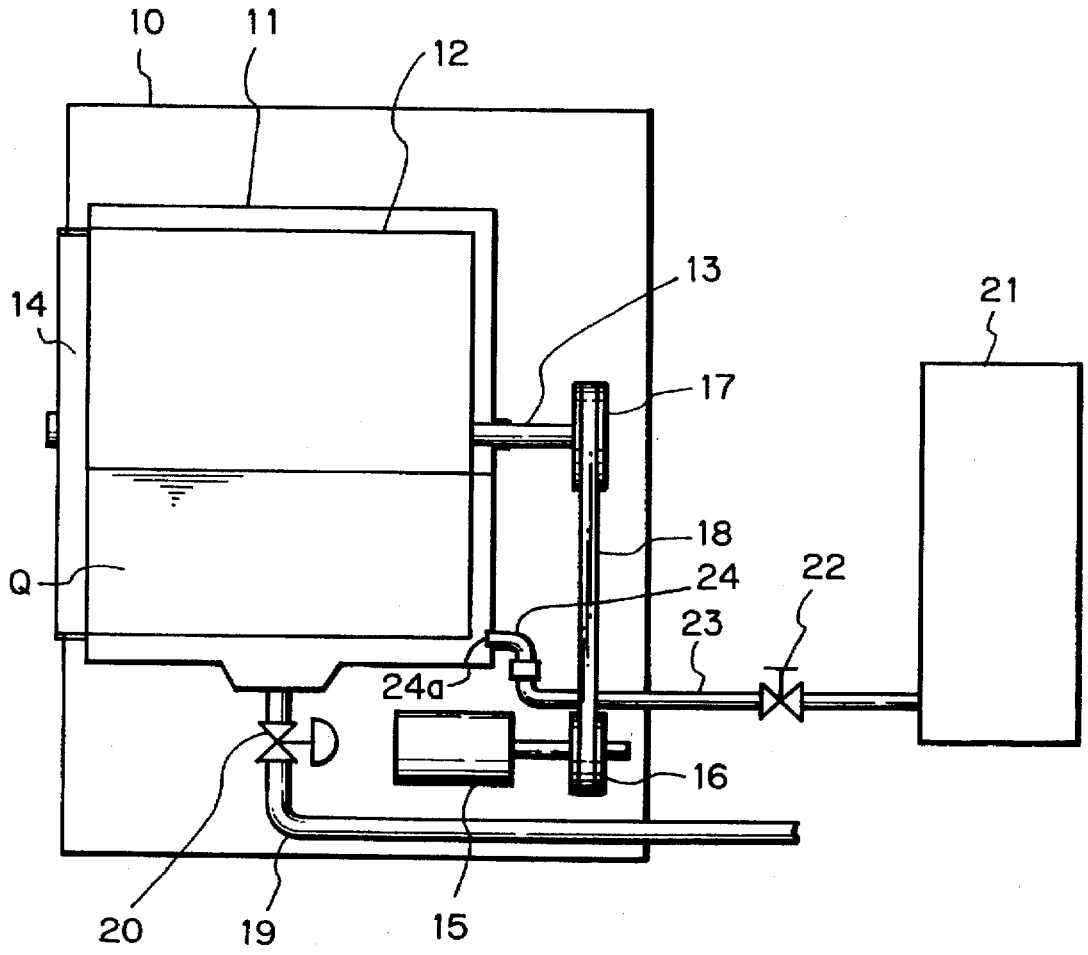
FIG. 2 shows schematically another commercial laundering apparatus for implementing the laundering method of the invention.

FIG. 2 shows schematically another commercial laundering apparatus for implementing the laundering method of the invention. Those parts which are identical or equivalent to the parts shown in FIG. 1 are identified by like numerals and this also applies to FIG. 3 which follow. The laundering apparatus shown in FIG. 2 differs from what is shown in FIG. 1 in that fitting 24 is provided in the bottom part of outer shell 11 other than liquid reservoir 10*a* in such a way that ozone gas supply port 24*a* is open between outer shell 11 and inner cylinder 12. Being constructed in this way, the laundering apparatus shown in FIG. 2 achieves generally the same operational advantages as the apparatus shown in FIG. 1.

Figure 3:
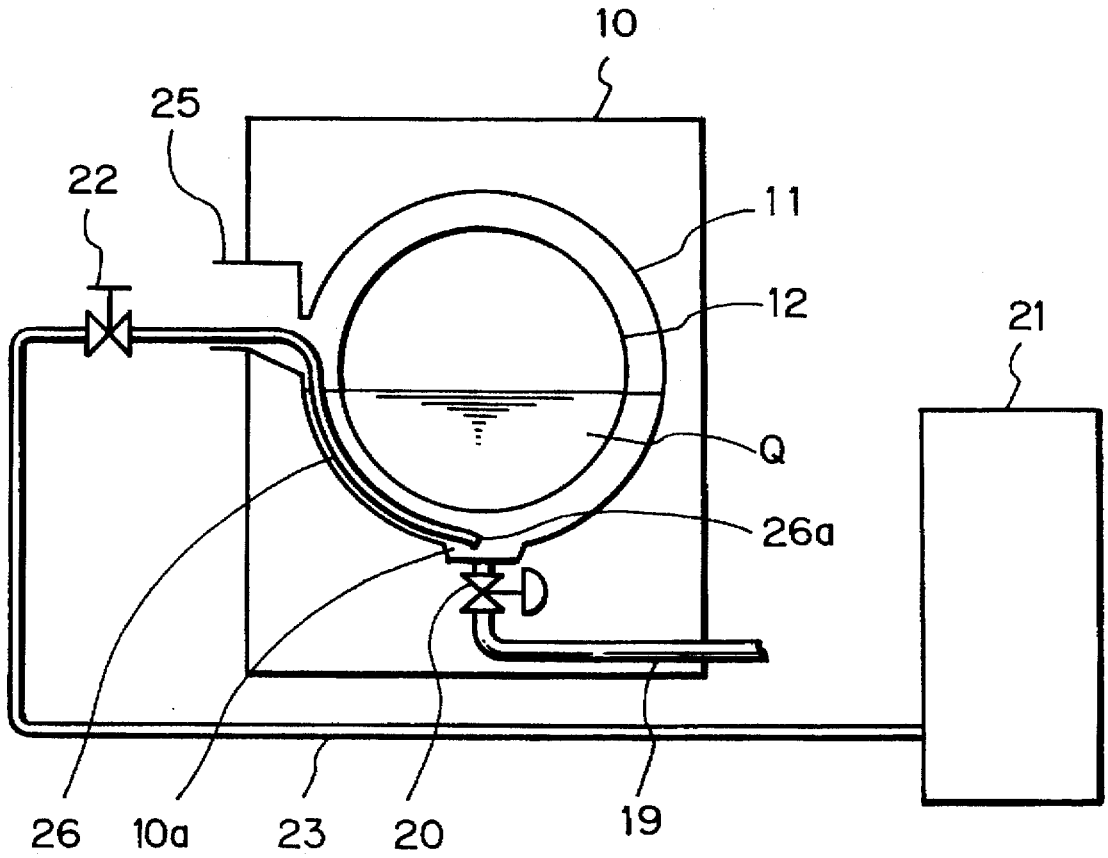
FIG. 3 shows schematically yet another commercial laundering apparatus for implementing the laundering method of the invention.

FIG. 3 shows schematically still another commercial laundering apparatus for implementing the laundering method of the invention. The laundering apparatus shown in FIG. 3 differs from what is shown in FIG. 1 in that an ozone supply pipe 26 is inserted between outer shell 11 and inner cylinder 12 through a starch supply port 25, with its distal end forming ozone supply port 26*a* which is open to the interior of liquid reservoir 10*a*. In this way, an existing washing machine 10 can be operated to implement the laundering method of the invention without any design modifications.

As described on the foregoing pages, the method recited in claim 1 offers the following advantages.

(1) A washing solution having a polyelectrolyte containing detergent dissolved therein is mixed directly with ozone gas for laundering. Due to the compound and synergistic actions of the ozone gas and the polyelectrolyte, the permeability of the washing solution into the articles to be laundered is enhanced and, at the same time, ozone can be effectively moved to the articles, whereby both the soil removing action of the detergent and the efficiency of bleaching with the ozone are sufficiently enhanced to achieve a marked improvement in detergency. As a result, the laundered articles have increased whiteness and feature a very high level of sharpness when featuring stripes or other patterns. In addition, the laundered articles show only slight wrinkle.

The method recited in claim 2 offers the following advantages.

(2) The washing solution having a polyelectrolyte containing detergent dissolved therein is held within the outer shell of a washing tub and laundering is performed as ozone gas is directly mixed into the washing solution between the outer shell and inner cylinder of the washing tub. As a result, the soil components that have been removed from the articles being laundered are immediately subjected to the oxidizing, decomposing and flocculating actions of ozone, whereby the washing solution is cleaned during laundering. What is more, the efficiency of soil removal is markedly improved.

(3) The volume of the articles that can be handled by one laundering operation is sufficiently increased to improve the washing capability of the laundering machine.

(4) Since washing water having lower temperatures than in the prior art will serve the purpose, laundering can be performed in a satisfactory manner without damaging the laundered articles as exemplified by the low shrinkage of fibers.

The method recited in claim 5 offers the following advantages.

(5) The ozone gas to be used in the method is generated by electrical discharge from oxygen gas having a concentration of at least 70% and compared to the case of ozonizing air, the amount of NOx in the generated ozone gas is insufficient to react with water to form nitric acid which would otherwise render the washing solution acidic.

What is claimed is:

1. A method of laundering clothes and textiles comprising the steps of:

providing a washing machine having:

a fixed outer shell;

an inner cylinder provided within said fixed outer shell, the inner cylinder having a peripheral wall with a plurality of orifices capable of passing a washing solution therethrough, the fixed outer shell and the inner cylinder forming a tub, a horizontal rotating shaft rotatably supporting the inner cylinder;

putting at least one of clothes and textiles into the inner cylinder;

charging the fixed outer shell and the inner cylinder with a washing solution having a polyelectrolyte-containing detergent dissolved therein; the washing solution being in an alkaline condition; and rotating the horizontal shaft and the inner cylinder so as to launder at least one of the clothes and textiles in the washing solution at a temperature from about 40° C. to less than 50° C. while an ozone gas is directly introduced into the washing solution through a supply port located between the fixed outer shell and the inner cylinder.

2. A method according to claim 1, wherein the supply port is located at the bottom of the outer shell.

3. A method according to claim 1, wherein the ozone gas is mixed into the washing solution only in the rotating step.

4. A method according to claim 1, further comprising generating the ozone gas by electrical discharge from oxygen gas at a concentration of 70% or more.

5. A method according to claim 2, further comprising generating the ozone gas by electrical discharge from oxygen gas at a concentration of 70% or more.

6. A method according to claim 3, further comprising generating the ozone gas by electrical discharge from oxygen gas at a concentration of 70% or more.

7. A method according to claim 1, wherein the clothes and textiles to be laundered are of a uniform color and chiefly made of cotton and/or polyesters.

8. A method according to claim 2, wherein the clothes and textiles to be laundered are of a uniform color and chiefly made of cotton and/or polyesters.

9. A method according to claim 3, wherein the clothes and textiles to be laundered are of a uniform color and chiefly made of cotton and/or polyesters.

10. A method according to claim 4, wherein the clothes and textiles to be laundered are of a uniform color and chiefly made of cotton and/or polyesters.

11. A method according to claim 1, wherein the polyelectrolyte is used in amounts that range from 0.5 to 2% by weight of the detergent used.

12. A method according to claim 1, wherein the ozone gas is supplied in amounts ranging from about 4 to about 40 mg/h per liter of the washing solution.

13. A method according to claim 1, wherein the polyelectrolyte is used in amounts that range from 0.5 to 2% by weight of the detergent used and the ozone gas is supplied in amounts ranging from about 4 to about 40 mg/h per liter of the washing solution.

14. A method according to claim 1, wherein the washing solution in the rotating step has a temperature of from about 40° C. to about 45° C.

15. A method according to claim 1, wherein the washing solution comprises water.

* * * * *